US005752886A

United States Patent [19]

Tien

[11] Patent Number: 5,752,886

[45] Date of Patent: May 19, 1998

[54] COMBINATION TABLE FOR BILLIARDS AND FOOTBALL TABLE GAMES

[75] Inventor: Feng-Yi Tien, Chia Yi Hsien, Taiwan

[73] Assignee: Hi Star Co., Ltd., Chia Yi Hsien, Taiwan

[21] Appl. No.: 781,627

[22] Filed: Jan. 10, 1997

[51] Int. Cl.[6] ..... A63D 15/04

[52] U.S. Cl. ..... 473/14; 273/108.1; 273/108.52

[58] Field of Search ..... 473/10, 11, 13, 473/12, 14; 273/108.1, 108.4, 108.5, 108, 108.54, 108.52

[56] References Cited

U.S. PATENT DOCUMENTS

| | | | |
|---|---|---|---|
| 1,641,525 | 9/1927 | Boessow | 473/10 |
| 1,967,217 | 7/1934 | Amsden | 273/108.4 |
| 3,871,655 | 3/1975 | Zimmers et al. | 473/10 |
| 4,063,728 | 12/1977 | Zemanek | 273/108.1 |

*Primary Examiner*—Mark S. Graham
*Attorney, Agent, or Firm*—Browdy and Neimark

[57] ABSTRACT

A combination table for both billiards and football table games comprising a billiards table, a supporting seat, and a football table is disclosed. The supporting seat has several supporting legs fixedly attached to the bottom of the billiards table. And the football table can be easily combined with the billiards table via an engaging frame flange inserted into a receiving frame groove. The billiards table is provided with descending tracks communicating corner pockets and side pockets of the billiards table with a ball collecting slot. The football table has slanting plates disposed at the inner side of goals. By means of the descending tracks and the slanting plates, a ball either billiards or football and whether dropped into the ball pocket directly or shot through the goal and then descended onto the pocket, will roll automatically downwards along the sloped descending track and end up finally at the ball collecting slot for retrieval.

1 Claim, 4 Drawing Sheets

COMBINATION TABLE FOR BILLIARDS AND FOOTBALL TABLE GAMES

BACKGROUND OF THE INVENTION

The present invention relates to a combination table for both billiard and football table games, comprising a billiard table, a supporting seat, and a football table wherein the billiard table and the football table can be easily combined or separated for their different uses. In addition, the billiard table is provided with descending tracks which communicate with ball pockets and a ball collecting slot. The football table also has slanting plates which communicate with ball pockets of the billiard table. Via the descending tracks and the slanting plates, a ball used to play either billiards or football can be easily and quickly retrieved to play again.

Nowadays, billiards and table football are very popular leisure activities. Yet, conventionally, the billiard table and the football table are designed separately and individually for their own purposes. For a lover of both billiards and table football, there are several drawbacks inherent in such conventional billiard and football tables.

First, it would take up a lot of space to have both a billiard table and a football table placed in one room. Second, the ball pockets of the billiard table and the goal of the football table are located at different positions. It is, therefore, difficult to combine both tables in one. Third, it would cost a lot of money to buy both tables separately.

SUMMARY OF THE PRESENT INVENTION

It is, therefore, the primary object of the present invention to provide a combination table for both billiard and football table games, comprising a billiard table, a supporting seat, and a football table wherein the billiard table and the football table can be combined or separated at will for their different uses. The billiard table has descending tracks which communicate with ball pockets and a ball collecting slot for the easy retrieval of the billiard balls. The football table is provided with slanting plates by which a football shot through a goal can descend onto the ball pockets of the billiard table so as to permit retrieval of the football easily and quickly through the ball collecting slot of the billiard table.

DETAILED DESCRIPTION OF THE PREFERRED EMBODIMENT

Figure 1:
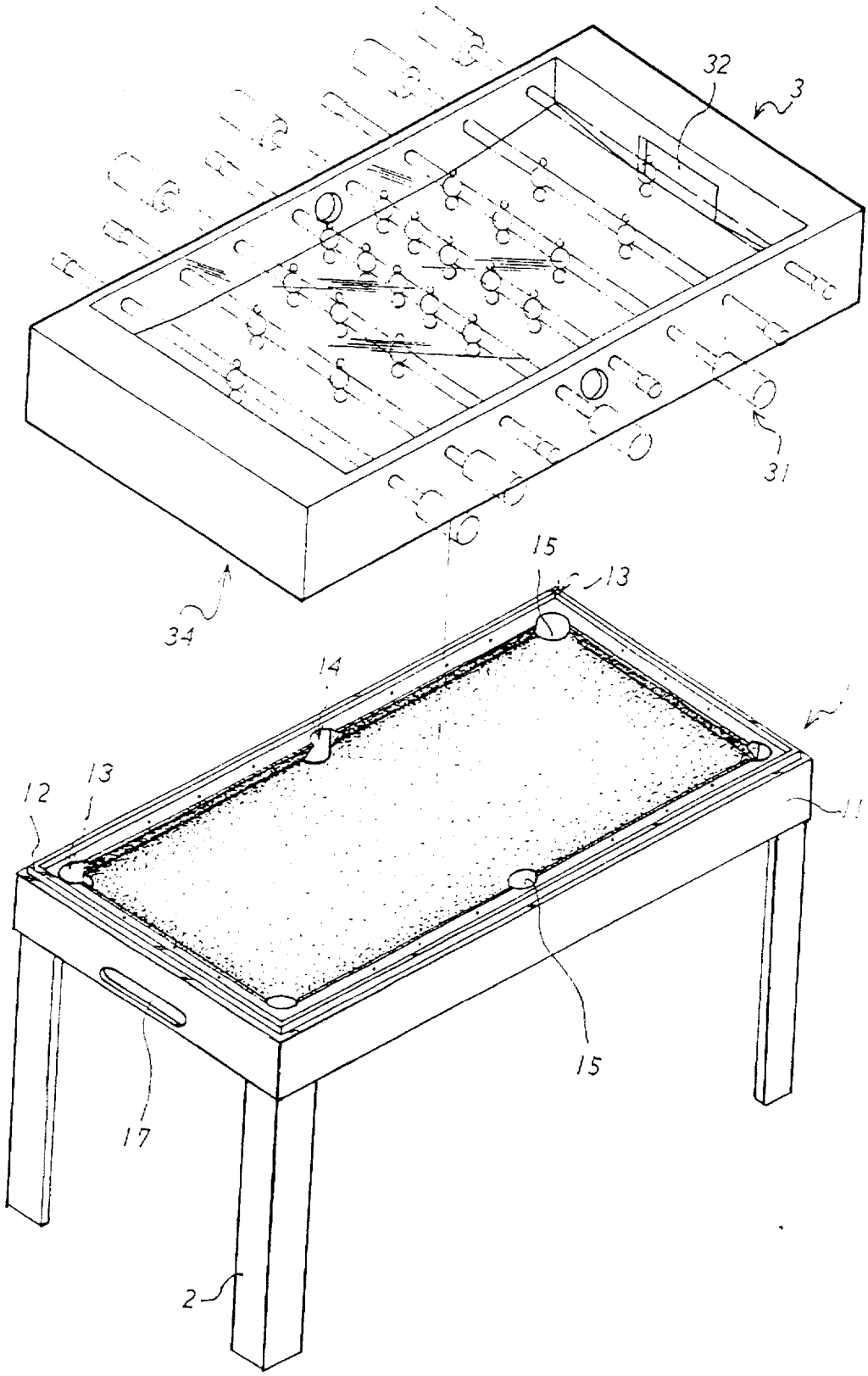
FIG. 1 is a diagram showing the structure of the present invention.

As shown in FIG. 1, the present invention relates to a combination table for both billiard and football table games, comprising a billiard table 1, a supporting seat 2, and a football table 3.

Figure 2:
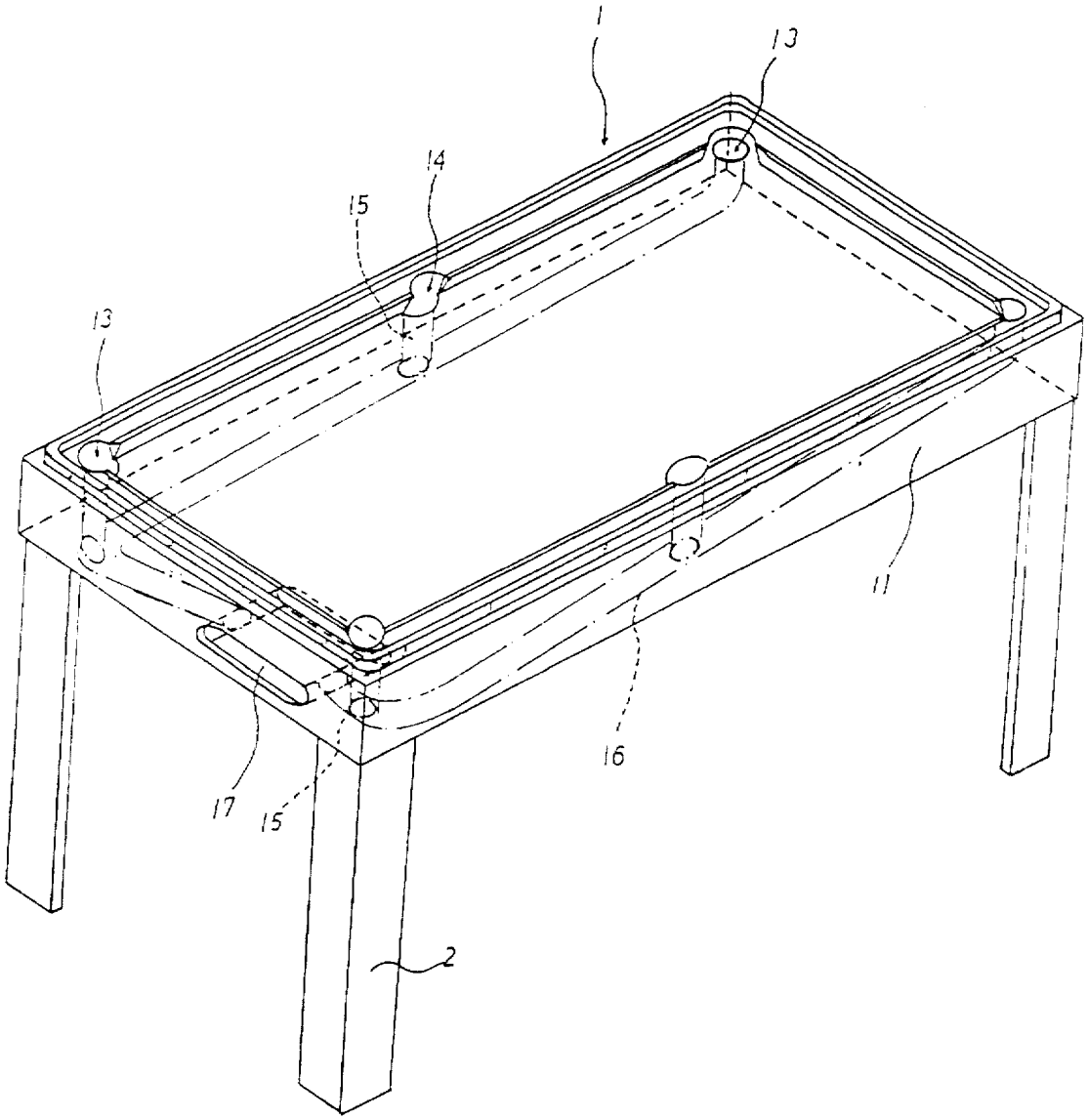
FIG. 2 is a perspective view of the billiard table of the present invention.
Figure 3:
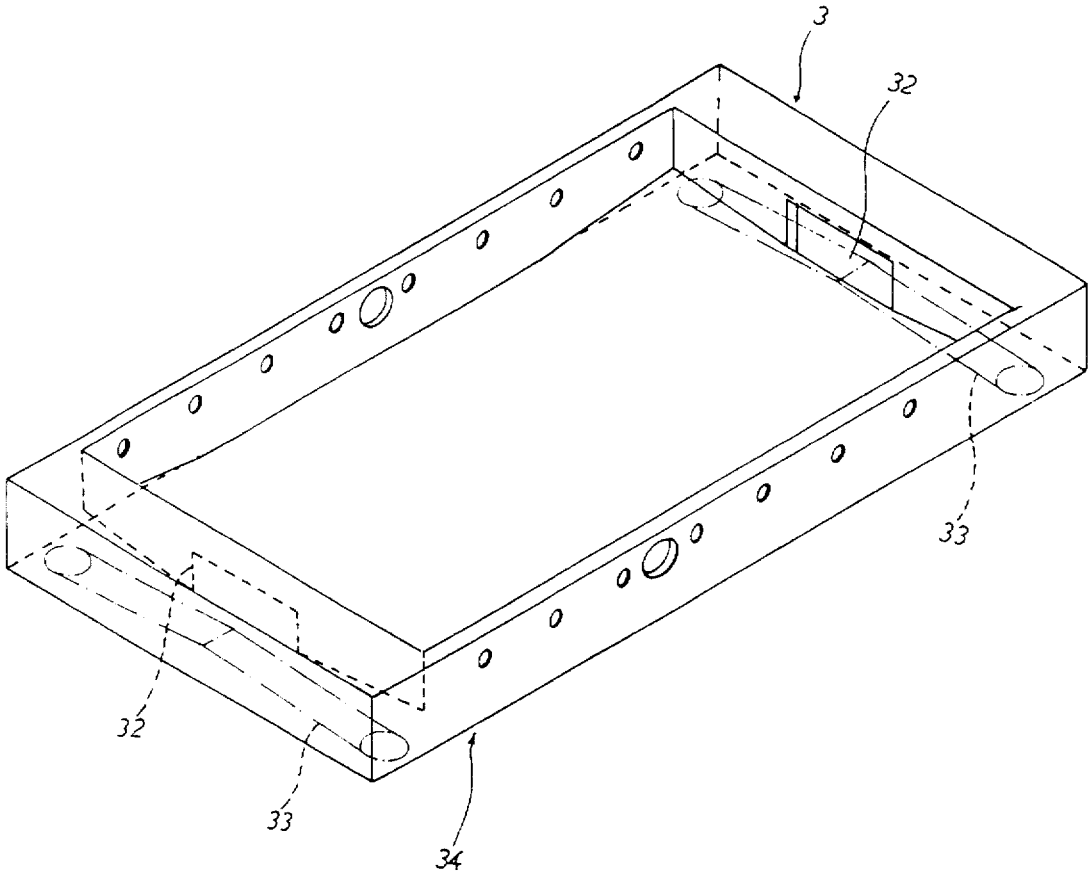
FIG. 3 is a perspective view of the football table of the present invention.

The billiard table 1 is made up of a rectangular frame body 11, having engaging frame flange 12 disposed at the top of the rectangular frame body 11. The rectangular frame body 11 is provided with a number of ball pockets 15. Corner pockets 13 are disposed at the four corners of the rectangular frame body 11 and side pockets 14 are disposed at the middle section of both longitudinal sides thereof. Descending tracks 16 slope down at a diagonal angle down from one end of the frame body 11 to the other end along each longitudinal side of the rectangular frame body 11. Each track 16 communicates with ball pockets 15 of both corner pockets 13 and the middle side pocket 14 thereof. The descending track 16 is further turned and extended to connect with a ball collecting slot 17 disposed at the front of the rectangular frame body 11 as shown in FIG. 2.

The supporting seat 2 is provided with supporting legs fixedly attached to the bottom of the billiard table 1.

The football table 3 is a frame-shaped table having a plurality of football doll-player posts 31 disposed thereon. Goals 32 are disposed at the front and rear lateral sides of the football table 3 respectively. At the inner side of each goal 32 is disposed a slanting plate 33, raising in the middle and sloping down at both lateral sides. A receiving frame groove 34 is provided at the underside of the football table 3 to match the engaging frame flange 12 of the billiard table 1.

By the above arrangement, one can easily and conveniently retrieve billiard balls when playing billiards. By means of the descending track 16 communicating with the ball pockets 15, including the corner pockets 13 and the side pockets 15, and the ball collecting slot 17, when a billiard ball drops into any pocket 15 it will roll automatically down along the slope of the descending track 16 and finally end up at the ball collecting slot 17 thereof. Thus, a billiard player can always locate the billiard ball quickly and easily for another round.

Figure 4:
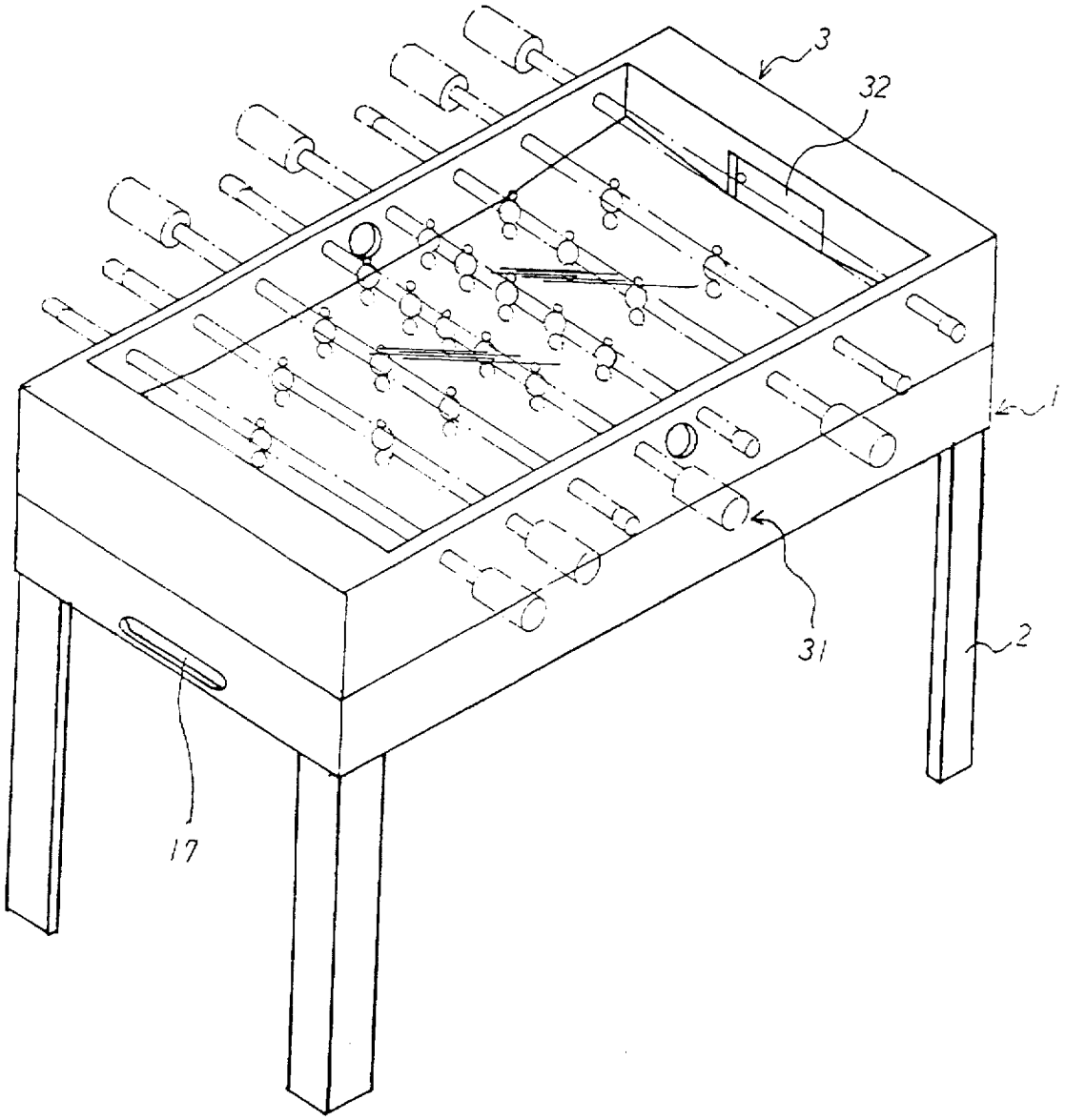
FIG. 4 is a diagram showing the combination of the billiard table and the football table of the present invention.

As shown in FIG. 4, said football table 3 can be easily assembled to the billiard table 1. The engaging frame flange 12 disposed at the top of the rectangular frame body 11 of the billiard table 1 is inserted into the receiving frame groove 34 disposed at the underside of the football table 3 so as to combine both billiard table 1 and football table 3 securely. Thereafter, when a football is shot into a goal 32, the ball will fall onto the slanting plate 33, and roll downward along the slope of either side of the slanting plate 33 and land finally at a corner pocket 13 of the billiard table 1. Consequently, whichever pocket 15 of the four corner pockets 13 the football drops into, the ball will descend along the descending track 16 and finally end up at the ball collecting slot 17. Thus, a player can easily and quickly retrieve a football as well as a billiard ball by the combination table for both billiard and football table games.

What is claimed is:

1. A combination table for both billiard and football table games, comprising a billiard table, a supporting seat, and a football table wherein, the supporting seat has several supporting legs fixedly attached to the bottom of the billiard table;

the billiard table is mainly made up of a rectangular frame body, having an engaging frame flange disposed at the top of said frame body and a plurality of ball pockets including corner pockets being disposed at the four corners thereof and side pockets being respectively disposed at each middle section of the longitudinal sides thereof; each longitudinal side of said longitudinal sides of the billiard table having a descending track sloping down from one end of each said longitudinal side to another end thereof and then turned and connected with a ball collecting slot disposed at a front of the billiard table, said descending track communicating with said corner pockets, said middle side pockets, and said ball collecting slot for the retrieval of a ball;

the football table being frame-shaped, having a plurality of football doll-player posts thereon, a goal respectively disposed at both a front and a rear end, and a receiving frame groove disposed at the underside thereof corresponding to and engaging the frame flange of the billiard table; said football table goal further having a slanting plate raised at a middle and descending on two sides;

wherein the billiard table and the football table can be easily combined, by engaging the frame flange of the billiard table thereof into the receiving frame groove of the football table thereof; and wherein by means of each said descending track of the billiard table and each said slanting plate of the football table, a billiard ball will roll automatically down the corresponding descending track to the ball collecting slot for retrieval and a football shot through one of the goals will fall upon the corresponding slanting plate, roll down one of said two sides to one of said corner pockets of the billiard table and down the corresponding descending track, to end at said ball collecting slot for retrieval.

* * * * *